US005820388A

United States Patent [19]

Walden

[11] Patent Number: 5,820,388

[45] **Date of Patent: *Oct. 13, 1998**

[54] LOW PROFILE SURFACE-MOUNTED CONNECTOR HAVING CURVED CANTILEVERED SPRING CONTACTS

[75] Inventor: John Donald Walden, Mechanicsburg, Pa.

[73] Assignee: Berg Technology, Inc., Reno, Nev.

[ * ] Notice: The term of this patent shall not extend beyond the expiration date of Pat. No. 5,433,616.

[21] Appl. No.: 895,666

[22] Filed: Jul. 17, 1997

Related U.S. Application Data

[60] Continuation of Ser. No. 465,528, Jun. 5, 1995, abandoned, which is a division of Ser. No. 185,444, Jan. 24, 1994, Pat. No. 5,433,616, which is a continuation of Ser. No. 21,642, Feb. 19, 1993, abandoned, which is a continuation of Ser. No. 730,985, Jul. 16, 1991, abandoned.

[51] Int. Cl.[6] ..... H01R 9/09

[52] U.S. Cl. ..... 439/62; 439/751

[58] Field of Search ..... 439/59, 62, 78, 439/492–494, 636, 637

[56] References Cited

U.S. PATENT DOCUMENTS

| | | | |
|---|---|---|---|
| 3,920,303 | 11/1975 | Pittman et al. | 339/91 R |
| 4,106,841 | 8/1978 | Vladic | 439/637 |
| 4,955,820 | 9/1990 | Yamada et al. | 439/83 |
| 5,433,616 | 7/1995 | Walden | 439/62 |

FOREIGN PATENT DOCUMENTS

| | | | |
|---|---|---|---|
| 270209 | 7/1964 | Netherlands | 439/637 |
| 6508627 | 1/1967 | Netherlands | 439/494 |
| 197707 | 7/1977 | Russian Federation | 439/637 |

*Primary Examiner*—P. Austin Bradley
*Assistant Examiner*—Tho D. Ta
*Attorney, Agent, or Firm*—Daniel J. Long; M. Richard Page

[57] ABSTRACT

A low profile, surface-mounted receptacle includes a housing having a cavity defined at least in part by the interior surfaces of the sidewalls thereof. The interior surface of at least one sidewall has a groove, one wall of the groove being defined by an inclined portion. An electrical spring contact is received within the groove, the contact being of the curved, dual cantilever type having a first leg, a curved transition portion and a second leg. The contact being disposed to define a clearance space between itself and the inclined. The legs and curved portion responding to the introduction of a male plug by cantilever toward the inclined sidewall and undergoing a reduction in the radius of curvature, thereby displacing to an extent sufficient to exert a predetermined normal force on the plug, despite dimensional variations in the housing due to manufacture.

4 Claims, 3 Drawing Sheets

LOW PROFILE SURFACE-MOUNTED CONNECTOR HAVING CURVED CANTILEVERED SPRING CONTACTS

This is a continuation of Ser. No. 08/465,528, filed on Jun. 5, 1995, now abandoned and which was a divisional of U.S. Pat. No. 5,433,616, issued on Jul. 18, 1995 (Ser. No. 08/185,444, filed on Jan. 24, 1994), which was a continuation of Ser. No. 08/021,642, filed Feb. 19, 1993, now abandoned and which was a continuation of Ser. No. 07/730,985, filed on Jul. 16, 1991, now abandoned.

BACKGROUND OF THE INVENTION

1. Field of the Invention

The present invention relates to a low profile, surface-mounted connector having curved cantilevered spring contacts.

2. Description of the Prior Art

Surface-mounted connectors are known in the art. A board to board surface-mounted connector system using a receptacle housing having a low profile, that is, a housing with a height above the board of approximately 0.170 inch, and having single cantilevered spring contacts therein is manufactured and sold by Hirose Inc. as the HRS DF9 Series Board to Board connector.

U.S. Pat. No. 4,682,829 (Kunkle et al.) and U.S. Pat. No. 4,693,528 (Asick et al.) also disclose surface-mounted connectors.

In a typical female receptacle having single or dual cantilevered mounted electrical spring contacts, such as those shown in U.S. Pat. No. 4,955,820 (Yamada et al.), U.S. Pat. No. 4,025,147 (Van Arsdale et al.), U.S. Pat. No. 4,715,820 (Andrews Jr., et al.), U.S. Pat. No. 3,601,775 (Longenecker et al.), U.S. Pat. No. 4,734,060 (Kawawada et al.), and U.S. Pat. No. 4,420,215 (Tengler), the magnitude of the normal force exerted on the contact of a male plug by a spring contact in the receptacle is determined, for a predetermined spring constant, by the magnitude of the beam deflection undergone by the spring contact within the receptacle housing.

The receptacle housing within which the spring contact is disposed is typically fabricated by a molding process. As a result there can occur variations in the dimensions of the housing which could reduce the magnitude of the beam deflection of the spring.

In most cases, for a cantilevered mounted electrical spring contact having a beam length of greater than approximately 0.135 inch and a housing height of greater than approximately 0.170 inch, a sufficient level of normal force may still be exerted by the spring contact despite dimensional variations in the housing due to manufacture.

However, in an environment where the available spacing between adjacent boards is an important factor, as when connecting conductive tracings on the surface of one substrate to tracings disposed on the surface of an adjacent substrate spaced about 0.200 inches apart, as within a cellular telephone, the height (i. e., distance above the board) of both the housing of the male plug and the housing of the corresponding female receptacle, as well as the height of the mated plug and receptacle, become critical. With a low profile receptacle housing (that is, one with a height less than approximately 0.170 inch) the beam length and the magnitude of available beam deflection within the housing become limited. Thus, to maintain the same desired level of normal force as in a typical connector, the contact in the receptacle of reduced height must exhibit an increased spring rate. However, in such an instance the effect of dimensional variations in the manufacture of the housing becomes more pronounced. Loss of a unit length of beam deflection due to a dimensional variation of the housing results in a wider variation in normal force generated by the contact.

The following discussion of actual connectors should make the preceding point clearer. For a high profile connector typically with a height of approximately 0.250 inch, the cantilever beam length is approximately 0.215 inch. Assuming a spring rate of approximately 15 grams/per thousandths of an inch and a deflection of approximately 0.010 inch, the normal force exerted by the beam is on the order of 150 grams. For a loss of 0.002 inch of deflection due to manufacturing tolerances, approximately 30 grams of normal force is lost, leaving a normal force exerted by the contact of approximately 120 grams. In contrast, for a low profile connector typically with a height of approximately 0.170 inch, a cantilever beam length of approximately 0.135 inch, a spring rate of approximately 50 grams/per thousandths of an inch and a deflection of approximately 0.003 inch, the normal force exerted by the beam is also on the order of 150 grams. However, for the same loss of 0.002 inch of deflection due to manufacturing tolerances, approximately 100 grams of normal force is lost, leaving a normal force exerted by the contact of approximately 50 grams.

Accordingly, it is believed advantageous to provide an arrangement for a receptacle in which relatively large effective beam deflection is permitted despite the reduction in available housing dimensions, so that the normal force exerted by the spring contact of the receptacle remains within a predetermined range despite dimensional variations of the housing due to manufacturing tolerances.

SUMMARY OF THE INVENTION

The present invention relates to a low profile, surface mounted receptacle having dual cantilevered spring contacts therein. The receptacle comprises a housing formed of an insulating material, the dimensions of the housing being susceptible to variation due to manufacture. The housing has a first, lower, major surface, and a second, upper, major surface, as well as first and second major sidewalls thereon. A central cavity, or recess, is provided in the housing, the cavity being defined at least in part by an interior sidewall. The interior surface of at least one sidewall has at least one groove formed therein. One wall of the groove is defined by an inclined portion of the surface of the interior of the sidewall.

At least one electrical spring contact is received within the groove. The contact is of the type having a first leg, a curved transition portion attached to the first leg, and a second leg attached at an end of transition portion. The transition portion has a predetermined radius of curvature associated therewith, while the second leg having a bowed wiping section intermediately therealong.

The contact is introducible into the groove through an opening defined in the first major surface of the housing. The contact is anchored within the housing at a predetermined anchor point such that the bowed wiping section lies a predetermined distance from the inclined portion of the surface of the sidewall, thereby to define a clearance space between the contact and the inclined portion of the sidewall.

The first leg and the second end respond to the introduction of a male plug into the cavity by respectively deflecting, each in a cantilevered manner, toward the inclined portion of the sidewall. The deflection of the first leg is defined about the anchor point, thus moving the leg into the clearance space. The deflection of the second is defined about the end of the transition region, moving the tip of the second leg toward the inclined sidewall. The transition portion responds to the introduction of the plug by undergoing a reduction in the radius of curvature.

The responses of the first leg, the second leg and the transition region collectively cause the wiping region to displace within the cavity from the predetermined position to a position closer to the sidewall. The magnitude of the displacement of the wiping region is sufficient to exert a predetermined normal force on the plug, despite dimensional variations in the housing due to manufacture.

BRIEF DESCRIPTION OF THE DRAWINGS

The invention will be more fully understood from the following detailed description thereof taken in connection with the accompanying drawings which form a part of this application and in which.

DETAILED DESCRIPTION OF THE INVENTION

Figure 1:
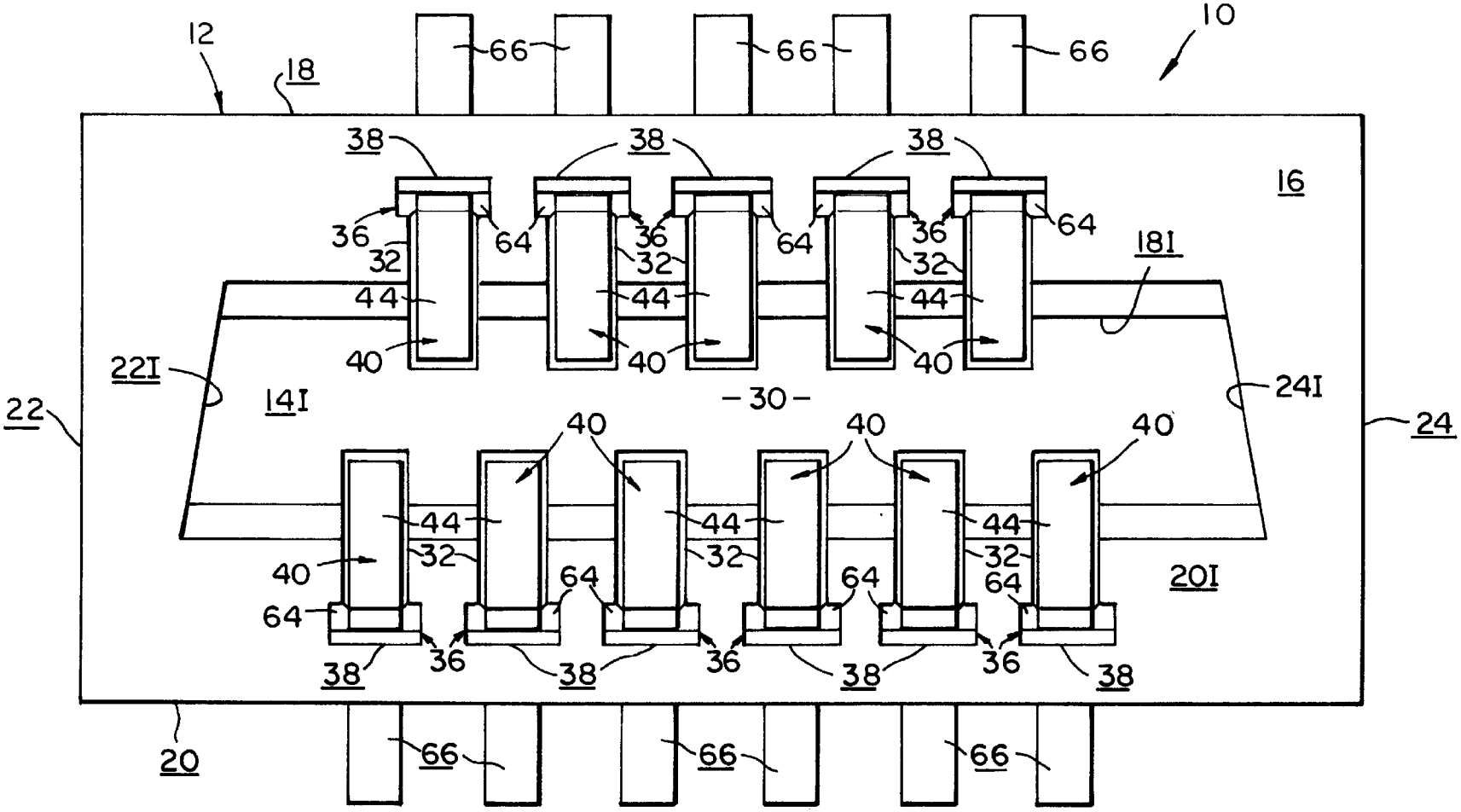
FIG. 1 is a plan view of a receptacle having dual cantilevered contact springs therein in accordance with the present invention.
Figure 2:
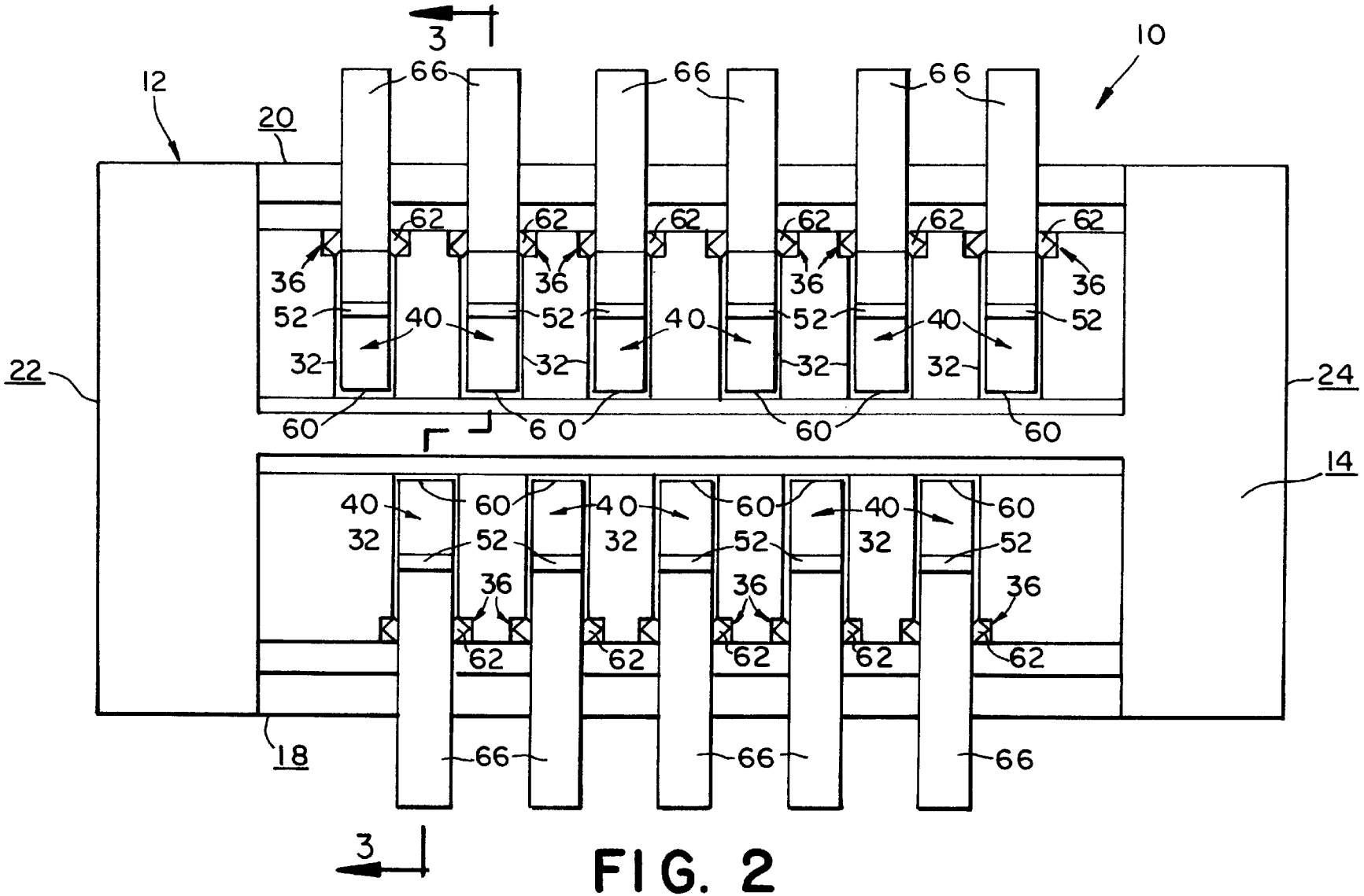
FIG. 2 is a bottom view of the receptacle of FIG. 1.

Throughout the following detailed description, similar reference numerals refer to similar elements in all Figures of the drawings.

With reference to the Figures a low profile receptacle generally indicated by the reference character 10 in accordance with the present invention includes a housing 12 fabricated of an insulating material. The housing 12 is a generally rectanguloid member having a first, lower, major exterior surface 14 and a second, upper, major exterior surface 16 thereon. In addition, the housing 12 has major sidewalls 18, 20 and endwalls 22, 24 thereon. The housing 12 is a low profile housing, that is, the height dimension 26 thereof above a substrate S (FIG. 3) is less than approximately 0.170 inches in height.

If desired, the endwalls 22, 24 may be provided with a suitable retention arrangement whereby the receptacle 12 may be secured to a substrate. Preferably, the retention system disclosed and claimed in copending application Ser. No. 07/730,984, now U.S. Pat. No. 5,120,256 may be used to retain the housing to the substrate. The lower major surface 14 of the housing 12 is that surface which lies proximal to the substrate S (FIG. 3) when the housing 12 is secured thereto. The substrate S may be either a rigid member, as circuit board, or a flexible member, as a flexible circuit.

The interior surfaces 18I, 20I of the major sidewalls 18, 20, respectively, and the interior surfaces 22I, 24I, respectively, of the endwalls 22, 24 cooperate with the interior surface 14I of the lower major surface 14 to define a cavity, or recess 30 within the housing 12. The cavity 30 interrupts the upper major surface 16 of the housing 12, presenting the common "D-shape". The lower surface 14 has openings 32 therein, through which the cavity 30 is accessible from the lower exterior surface of the housing 12. A reference plane R (FIG. 3) extends centrally and axially through the cavity 30, the reference plane R being preferably defined as extending perpendicular to both the lower and upper major surfaces 14, 16, respectively.

The interior surfaces 18I, 20I of the sidewalls 18, 20 have generally T-shaped channels, or grooves, 36 formed therein. The grooves 36 extend for substantially the full height of the housing 12 between the lower surface 14 and the upper surface 16 thereof. A portion 38 of the interior surfaces 18I, 20I, defining the heads of the T-shaped grooves 36 is inclined at a predetermined angle 39 with respect to the reference plane. Preferably, the angle of inclination 39 is on the order of four (4) degrees.

At least one, but preferably, a plurality of electrical spring contact elements 40 are received within the cavity 30, each contact 40 being disposed in a respective one of the grooves 36. The spring contact elements 40 each preferably takes the form of a so-called curved cantilever contact, as set forth at pages 104 to 107 of "Ney Contact Manual", by Kenneth E. Pitney, The J. M. Ney Company (1973).

Figure 3:
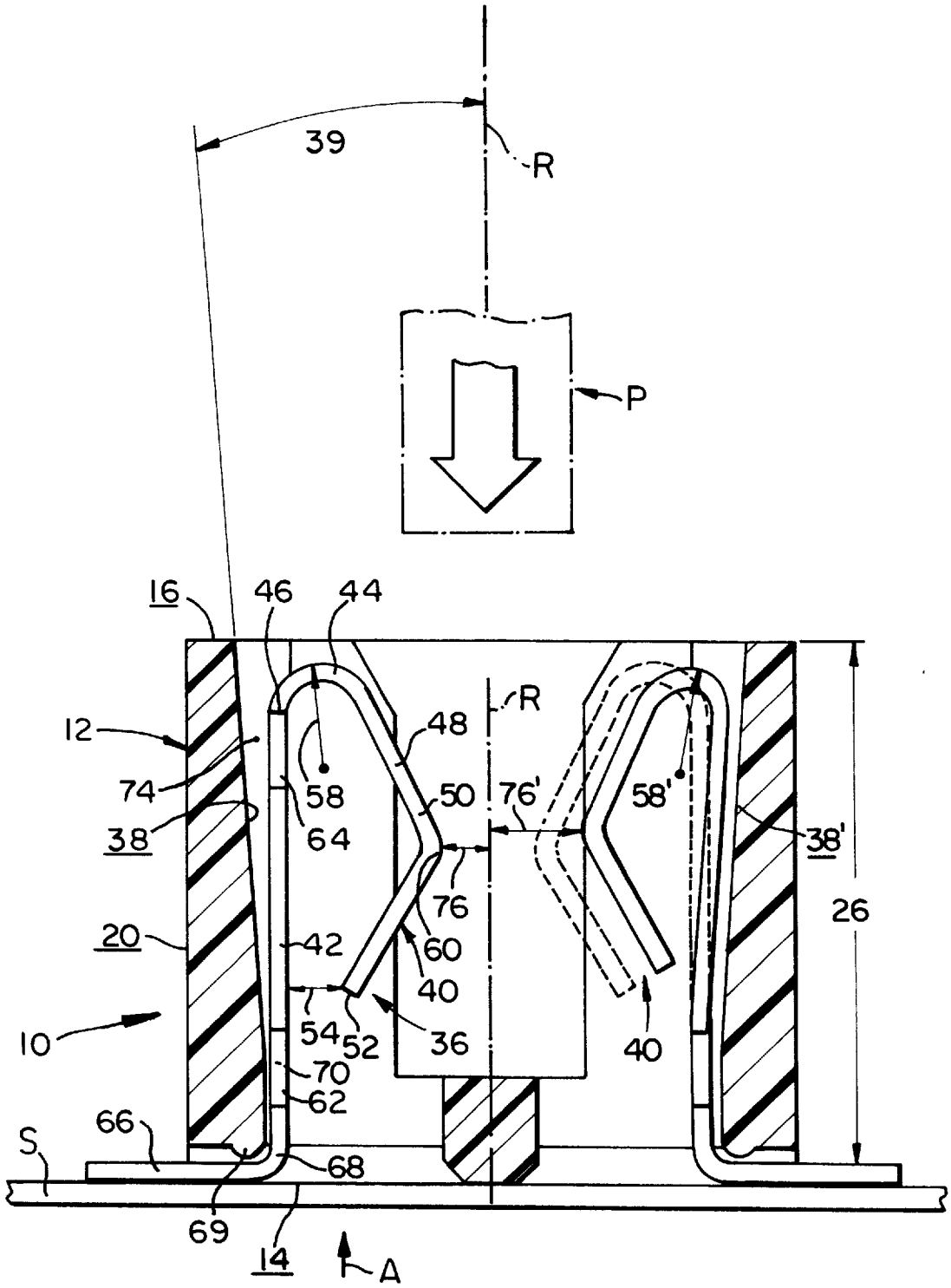
FIG. 3 is a section view of the receptacle of FIG. 2 taken along section lines 3—3 therein.

As is best seen in FIG. 3, each spring contact element 40 has a first leg portion 42, a curved transition portion 44 attached at a first end 46 to the first leg 42 and at a second end 48 to a second leg portion 50. The second leg portion 50 terminates in a tip 52, the tip 52 being spaced a predetermined gap distance 54 from the first leg portion 42. The transition portion 44 has a predetermined initial outside radius of curvature 58 associated therewith. A bowed wiping section 60 is disposed intermediately along the second leg portion 50. The first leg portion 42 has at least one, but preferably a pair of barb(s) 62 projecting from the lateral edges thereon. Also, at least one, but preferably a pair, of flange(s) 64 are provided on the first leg portion 42, the flanges 64 being spaced a predetermined distance from the barbs 62. The first leg portion 42 terminates in an elongated tail section 66, which is bent at a line of bending 68 to facilitate surface mounting of the receptacle 10 to the substrate S. To facilitate the bending of the tail section 66, the housing may be provided with a mandrel 69.

The spring contacts 40 are introducible into the grooves 36 through the openings 32 defined in the lower major surface 14, the direction of introduction being indicated by the reference arrow A. The entry of the spring contacts 40 into the cavity 36 is guided by the advancement of the flanges 64 within the grooves 36. The contacts are each anchored within the housing 12 at a predetermined anchor point 70 defined by the engagement of the barbs 62 with the material of the sidewalls of the grooves 36. When so secured a clearance space 74 is defined between the first leg portion 42 of each contact 40 and the inclined portion 38 of the sidewall. In such a disposition the bowed wiping section 60 on the second leg portion 56 lies a predetermined distance 76 from the reference plane R.

The housing 12 is fabricated from an insulating material, preferably by an injection molding process. As such the dimensions of the housing 12 are susceptible to variation due to manufacture. As shown earlier, in environments where the available spacing is limited and a low profile housing is required, the effect of dimensional variations incurred during the manufacture of the housing becomes more pronounced.

The low profile receptacle in accordance with the present invention permits the magnitude of beam deflection, and thus the level of normal force attainable, to be maintained near the magnitude and force level attainable with a larger-sized receptacle housing. The normal force thus able to be exerted by the spring contact elements of the low profile housing in accordance with this invention is rendered relatively impervious to variations in the housing dimensions due to manufacture.

This desirable end is accomplished in accordance with the present invention by the disposition of the dual cantilevered curved leg contact 40, as described above, within a housing 12 in which a portion 38 of the interior sidewalls is inclined with respect to the reference plane R extending through the cavity 30.

In use, when a plug P, shown in dot-dash lines is introduced into the receptacle in accordance with the invention, both the first leg 42 and the second leg 50 respond by deflecting, each in a cantilevered manner, toward the inclined portion 38 of the sidewall. The cantilevered motion of the first leg is defined about the anchor point 70 while the cantilevered motion of the second leg 50 is defined with respect to the second end 48 of the transition portion. The first leg thus moves into the clearance space 74, while the tip 52 of the second leg 50 closes the gap 54 and moves toward the first leg 42 and the inclined portion 38 of the sidewall. Further, the the transition portion 44 responds to the introduction of the plug P by undergoing a reduction in the radius of curvature to the radius 58' from the initial outside radius of curvature of approximately 0.015 inches.

The responses of the first leg 42, the second leg 50 and the transition portion 44 collectively cause the wiping region 60 to displace within the cavity 30 from the predetermined position 76 to a position 76' closer to the inclined portion 38 of the sidewall, thus spacing the wiping region farther from the reference plane R. The low profile connector 10 of the present invention affords a displacement of the wiping region 60 of the contact sufficient to permit the contact to exert a predetermined normal force on the plug, with little effect of dimensional variations of the housing due to manufacture.

For example, a low profile connector in accordance with the present exhibits a height of approximately 0.170 inch, but nevertheless defines dual cantilever beams having a total beam length of approximately 0.230 inch, as follows: the first leg, from anchor point 70 to the end 46 of the transition region, 0.095 inches; the curved transition region, from the end 46 to the end 48 thereof, 0.060 inches; the second leg, from the end 48 of the transition region to the tip 52, 0.075 inches. If the contact has a spring rate of approximately 15 grams/per thousandths of an inch, and if a deflection of approximately 0.010 inch is permitted within the housing 12, then the contact may exert a normal force on the order of 150 grams. However, for a loss of 0.002 inch of deflection due to manufacturing tolerances, only approximately 30 grams of normal force is lost, leaving a normal force exerted by the contact of approximately 120 grams. Thus, the low profile connector of the present invention provides a normal force that parallels that of a high profile connector. Dimensional variations due to manufacture have little effect on the level of normal force exerted.

Those skilled in the art, having the teachings of the present invention as hereinabove set forth, may effect numerous modifications thereto. It should be understood that these and such modifications lie within the contemplation of the present invention, as defined by the appended claims.

What is claimed is:

1. A spring-type electrical contact comprising:

a first leg;

a second leg having a wiping section thereon;

a radiused transition portion that is unitary with said first leg at a first end thereof and is unitary with said second leg at a second end thereof; and a flange connected to said first leg for guiding and constraining said first leg to move only within a predetermined range of motion;

said first leg, said second leg, and said transition portion being constructed and arranged so that (i) said first leg will cantilever about an anchor point;

(ii) said second leg will cantilever about said second end of said transition portion; and (iii) said transition region will undergo a reduction in its radius of curvature when lateral contact force is imparted to said wiping section.

2. The connector according to claim 1, wherein the distance on said first leg from said anchor point to said first end of said transition region is approximately 0.095 inches.

3. The connector according to claim 1, further comprising a tail region connected to said anchor point.

4. The connector according to claim 1, wherein said anchor point comprises a barb.

* * * * *